US007950612B2

(12) United States Patent
Conner, Sr.

(10) Patent No.: US 7,950,612 B2
(45) Date of Patent: May 31, 2011

(54) CONTAINER DEVICE FOR A LADDER

(75) Inventor: Michael E. Conner, Sr., Petersburg, VA (US)

(73) Assignee: C & W Container Corporation, Petersburg, VA (US)

( * ) Notice: Subject to any disclaimer, the term of this patent is extended or adjusted under 35 U.S.C. 154(b) by 0 days.

(21) Appl. No.: 12/381,458

(22) Filed: Mar. 11, 2009

(65) Prior Publication Data

US 2009/0242580 A1 Oct. 1, 2009

Related U.S. Application Data

(63) Continuation-in-part of application No. 11/651,658, filed on Jan. 10, 2007, now Pat. No. 7,520,479.

(51) Int. Cl.
*E06C 7/14* (2006.01)

(52) U.S. Cl. ..... 248/211; 206/1.9

(58) Field of Classification Search ..... 248/211, 248/210, 238, 311.2; 206/1.9, 1.8; 220/570
See application file for complete search history.

(56) References Cited

U.S. PATENT DOCUMENTS

| | | | |
|---|---|---|---|
| 3,661,351 | A | 5/1972 | Olsen |
| 3,738,601 | A | 6/1973 | Gehringer |
| 4,036,463 | A | 7/1977 | Hopkins et al. |
| 4,403,368 | A | 9/1983 | Harper |
| 4,765,123 | A | 8/1988 | Caldwell |
| 4,893,723 | A | 1/1990 | Seabolt |
| 5,052,581 | A | 10/1991 | Christ et al. |
| 5,062,607 | A | 11/1991 | Kisner |
| 6,076,636 | A | 6/2000 | Tietge |
| 7,083,044 | B1 | 8/2006 | Kilian et al. |
| 7,143,987 | B2 | 12/2006 | Salani |
| 7,520,479 | B1 | 4/2009 | Conner |
| 2006/0196999 | A1 | 9/2006 | Owens et al. |
| 2006/0226156 | A1 | 10/2006 | Lundy et al. |

OTHER PUBLICATIONS

U.S. Appl. No. 11/432,601, filed May 11, 2006, Willison, George R.

*Primary Examiner* — Ramon O Ramirez
(74) *Attorney, Agent, or Firm* — Williams Mullen

(57) ABSTRACT

A container device having a paint receptacle allows a user to easily access paint with a brush while working on a ladder. The container device includes one or more fixed brackets for attachment to a desired ladder rung and a pivotable bracket to stabilize the container device on a lower ladder rung. The paint receptacle maintains the paint in a convenient manner during use and includes an interior wipe board for removing excess paint from a paint brush and a brush clamp for storing a paint brush when not in use. A lid and handle are also included for tightly sealing any remaining paint therein during transportation and storage. A fabric cover having a series of pockets can be placed on the lower portion of the container device for carrying various painting tools and accessories.

34 Claims, 20 Drawing Sheets

CONTAINER DEVICE FOR A LADDER

CROSS REFERENCE TO RELATED APPLICATIONS

The present application claims priority to and is a continuation-in-part of U.S. application Ser. No. 11/651,658 filed Jan. 10, 2007 now U.S. Pat. No. 7,520,479, which is hereby incorporated by reference.

FIELD OF THE INVENTION

The invention herein pertains to receptacles and particularly pertains to a paint receptacle for releasable attachment to the rungs of a ladder.

BACKGROUND

Paint buckets, cans and trays along with other devices have long been used to hold paint during the manual application process. Painting with a brush while standing on a ladder requires a moderate degree of agility and care as the paint container must be secured to prevent spillage. As the ladder is often moved during the painting process special care has to be taken in holding a conventional paint can to prevent spillage. Also, space has to be available for the placement of tools normally employed, such as stirrers, scrapers, putty knives and the like as such tools are frequently used and exchanged with the painter's brush. Fold-out trays on step ladders do not sufficiently secure a typical can of paint. Also, painters' tools are often laden with wet paint thereby presenting a dilemma in maintaining such tools in a manner that is easily accessible.

Efforts to solve such problems have heretofore focused on using a standard-issue paint can in which paint retailers sell paint to consumers. Those efforts have generally sought to integrate the standard paint can with the ladder, oftentimes resulting in the can being mounted or hung onto the side of the ladder. Such an arrangement results in weight imbalance and requires additional room to be present on one side of the ladder, which may not be available when painting in areas with tight spaces. Attempts to integrate a standard paint can with a ladder may also include other substantial shortcomings, including blockage of access to ladder rungs, structural impediments to working areas above the paint can, lack of steadiness in the position of the paint can, and other deficiencies. The limitations present in such attempts stem from inherent problems associated with trying to integrate a standard paint can with a ladder, a purpose for which the standard paint can is not designed.

Therefore, based on the problems and disadvantages of conventional containers and methods used while painting, especially while painting while on a ladder, the present invention was conceived and one of its objectives is to provide a container device for affixing to a ladder having a paint receptacle which will maintain a quantity of paint in a convenient and safe manner.

It is another objective of the present invention to provide a container device which includes a pair of fixed brackets for affixing the container device to a ladder rung and a pivotable bracket for affixing to a lower ladder rung for stabilization of the container device on the ladder rungs.

It is still another objective of the present invention to provide a container device which includes a lid that can be placed on the paint receptacle for providing an air tight or substantially air tight seal, thereby sealing any remaining paint therein and maintaining the paint in a fresh condition for later use.

It is yet another objective of the present invention to provide a container device with a paint receptacle which includes a wipe board therein for removing excess paint from a paint brush while painting and a bracket for releasably maintaining a paint brush within the paint receptacle.

It is a further objective of the present invention to provide a cover for a container device which is formed from fabric or other flexible materials and includes pockets for maintaining various painting accessories against the container device.

It is still a further objective of the present invention to provide a container device which includes a handle with locking tabs which can be raised upright to a vertical position to lock the lid in place for ease in transporting the container device having paint therein.

Various other objectives and advantages of the present invention will become apparent to those skilled in the art as a more detailed description is set forth below.

SUMMARY OF THE INVENTION

The present invention realizes the objectives set forth above in a novel manner by including a paint container device that, unlike a standard paint can, is well suited to be attached to a ladder and easily and safely accessible by a painter who is painting while on the ladder. The present invention provides an affordable container device having a paint receptacle therein for receiving a quantity of paint from a standard paint can. The container device is rectangular in shape and has a front wall, a pair of side walls and a rear wall. The container device includes a pair of fixed inverted L-shaped brackets affixed to the top outside of the rear wall for attaching to the rung of a ladder. A third, pivotable bracket for attachment to another or lower ladder rung for stabilization of the container device is affixed at the bottom outside of the rear wall and maintained within a groove provided in the rear wall when not in use. The brackets maintain the container device in a stable position on the ladder to allow a painter positioned on the ladder convenient access to the paint while painting and thereafter the ability to move the ladder with the container device positioned thereon without spillage.

The pivotable bracket includes studs which are positioned on each side of the head of the pivotable bracket and are received in channels formed within the groove to lock the pivotable bracket in an upright dormant position. In use, the pair of fixed brackets is affixed to a ladder rung and the pivotable bracket is rotated outwardly and downward from the groove for engagement with a lower ladder rung. Inside the paint receptacle a wipe board allows the user after saturating a paint brush with paint to wipe any excess paint therefrom. A U-shaped bracket is affixed to the interior side wall of the paint receptacle for supporting the handle of a paint brush during storage. A lid allows any remaining paint in the paint receptacle to be sealed therein to prevent solvent evaporation of the paint and an external handle can be rotated over the lid to lock the lid in place while transporting or during periods of dormancy. Locking tabs on the handle engage slides along each end of the lid to apply pressure to seal the lid in a substantially air tight condition.

A cover formed from a flexible material such as a canvas-like fabric can be placed on the container device. The cover includes an elastic band around the top for securing the cover to the container device and exterior pockets on the cover provide space for storage of small tools and paint accessories. A channel is provided in the rear of the cover to allow for access and movement of the pivotable bracket.

In an embodiment of the invention, a container device for releasable attachment to a ladder having a plurality of rungs is provided in which the container device includes (a) a receptacle (optionally divided into a first compartment and second compartment (with the first compartment optionally substantially larger than the second compartment) by a dividing wall), the receptacle having a bottom, a front wall, a rear wall, and a pair of side walls, with the front wall, rear wall, and pair of side walls defining a top opening; (b) at least one fixed bracket, the at least one fixed bracket fixedly attached to the receptacle (optionally at its rear wall) and extending out from the receptacle to define a downwardly facing first notch located below the top opening of the receptacle and adapted to receive a first ladder rung; and (c) a longitudinally pivotable bracket having a proximal end and a distal end, the pivotable bracket pivotably attached to the receptacle at the pivotable bracket's proximal end and adapted to receive a second ladder rung at its distal end. In some embodiments of the invention, the at least one fixed bracket includes a first fixed bracket (optionally L-shaped) and a second fixed bracket (optionally L-shaped), the second fixed bracket being fixedly attached to the receptacle and extending out from the receptacle (optionally to its rear wall) to define a second downwardly facing notch adapted to receive the first ladder rung, with the second notch being located below the top opening of said receptacle. An optional third bracket may also be included in which the third bracket is fixedly attached to the receptacle and extends out from the receptacle to define a third downwardly facing notch located below the top opening of said receptacle and adapted to receive the first ladder rung. Optionally, the container device may include two arm pivots, with the pivotable bracket being releasably connected to the two arm pivots and the two arm pivots being releasably connected to the receptacle. The receptacle may also define a groove in which the pivotable bracket may be maintained, with the pivotable bracket optionally releasably connectable to the optional third fixed bracket or to an optional holding strap attached to the rear wall of the receptacle when so maintained. The container device optionally includes a cover (optionally formed from a flexible material such as canvas) positioned on the receptacle, with the cover optionally defining a cover opening aligned with the optional groove, optionally including one or more pockets formed from a flexible material such as canvas, optionally including an elastic band, with the elastic band being attached to the cover and formed from a flexible material, and optionally including a holding strap to which the pivotable bracket may be releasably connected.

In some embodiments of the invention, the pivotable bracket includes a shank pivotably attached at or near the bottom of the rear wall of the receptacle (or at or near the bottom of the receptacle) at the pivotable bracket's proximal end, the shank extending to the distal end of the bracket, and the pivotable bracket further includes fingers at the distal end of the bracket, with the fingers being attached to the shank and adapted to receive a second ladder rung, with the pivotable bracket optionally capable of a range of rotation sufficient to position the fingers at a location below or even directly beneath said receptacle and optionally including an engagement edge which may be positioned against the bottom of the receptacle.

In another embodiment of the invention, a container device for releasably attaching to a ladder having a plurality of rungs is provided, with the device including (a) a receptacle (optionally divided into a first compartment and second compartment (with the first compartment optionally substantially larger than the second compartment) by a dividing wall), the receptacle having a bottom, a front wall, a rear wall, and a pair of side walls, wherein the front wall, rear wall, and pair of side walls define a top opening; (b) a lid positionable on the receptacle to seal the receptacle (with the lid optionally defining a hole and having a flexible grommet disposed within the hole (and optionally positioned above the optional second compartment of the receptacle), with the grommet optionally having one or more slits and the slits forming a plurality of flexible portions, with the flexible portions capable of frictionally engaging an object positioned within the grommet); (c) at least one fixed bracket fixedly attached to the receptacle (optionally to its rear wall) and extending out from the receptacle to define a downwardly facing first notch located below the top opening of the receptacle and adapted to receive a first ladder rung; and (d) a longitudinally pivotable bracket having a proximal end and a distal end, the pivotable bracket pivotably attached to said receptacle at the pivotable bracket's proximal end and adapted to receive a second ladder rung at its distal end. (Optionally, (a) the receptacle has an outside surface and an inside surface and further includes a protuberance continuously disposed around the perimeter of the receptacle at or near the top of the receptacle on the outside surface of the receptacle, (b) the lid has an outside edge and further includes (i) a locking hook continuously disposed around the lid at or near the outside edge, (ii) an inner seating ring continuously disposed around the lid near the outside edge, and (iii) an outer sealing ring continuously disposed around the lid at a position between the locking hook and the inner sealing ring, and (c) the locking hook is releasably positionable against the protuberance, with the inner sealing ring being releasably positionable against the inside surface of the receptacle, and the outer sealing ring being releasably positionable against the outside surface of the receptacle with sufficient pressure to seal the receptacle in an airtight or substantially airtight manner.) In an alternative embodiment, the device further includes a pivotable handle attached to the receptacle and may optionally further include locking tabs on the pivotable handle and tab slides on the lid, with the locking tabs frictionally engaging the tab slides when the pivotable handle is rotated to a substantially vertical position. Optionally, the device may further include a clamp affixed to the receptacle (possibly to the optional second compartment) for mounting a brush. The device may optionally include a wipe board attached to the receptacle (possibly to the optional first compartment). Optionally, the device may include the groove or the cover discussed above, or both.

In another embodiment of the invention, a container device for releasable attachment to a ladder having a plurality of rungs is provided, the container device having (a) a receptacle defining a top opening; (b) at least one fixed bracket, the at least one fixed bracket fixedly attached to the receptacle and extending out from the receptacle to define a downwardly facing first notch located below the top opening of the receptacle and adapted to receive a first ladder rung; and (c) a longitudinally pivotable bracket having a proximal end and a distal end, the pivotable bracket pivotably attached to the receptacle at the pivotable bracket's proximal end and adapted to receive a second ladder rung at its distal end. This embodiment may also have one or more of the optional features discussed above.

DETAILED DESCRIPTION

Figure 1:
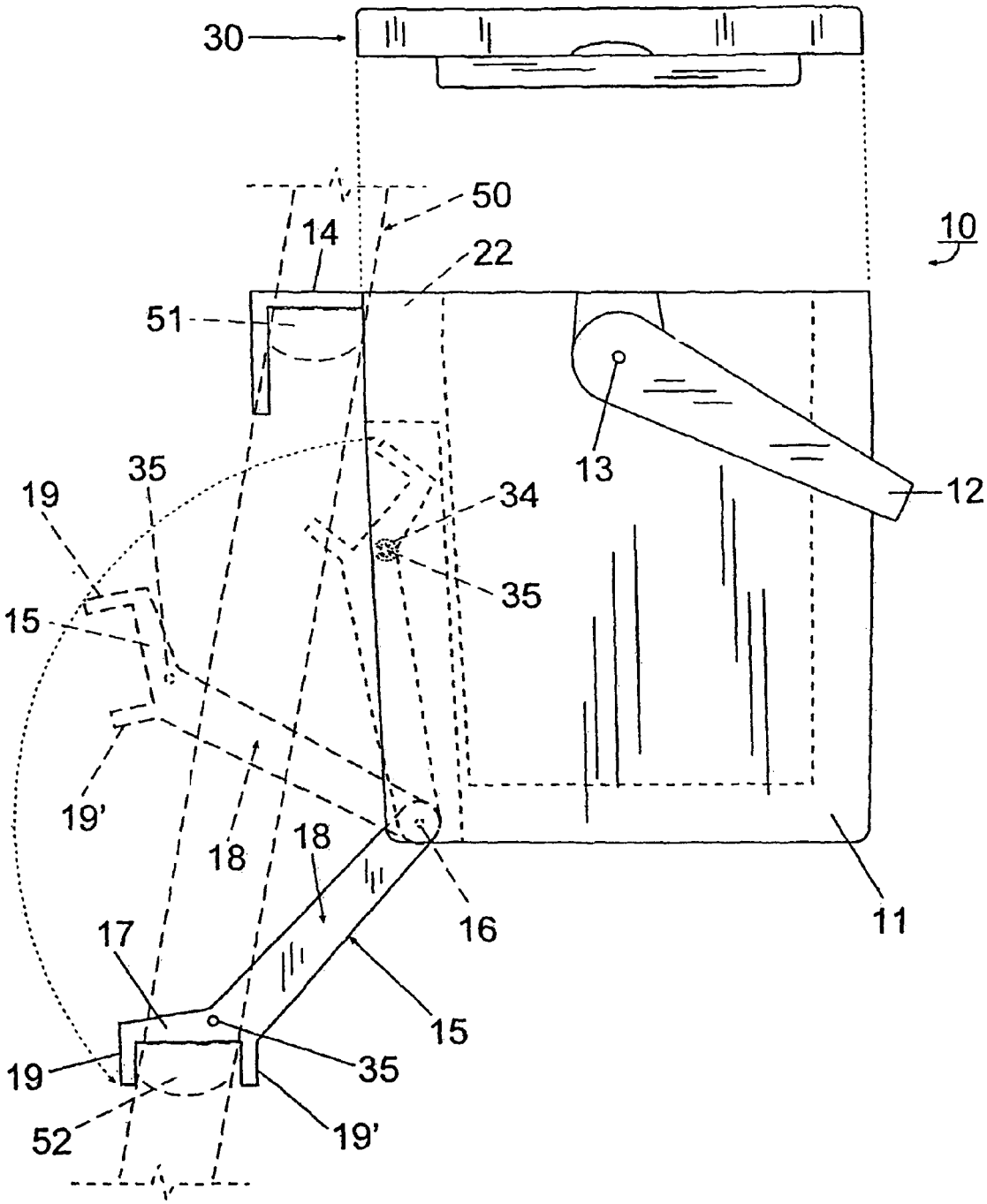
FIG. 1 shows a left side elevational view of the container device of the invention with the lid and cover removed and as affixed to an imaginary ladder with brackets, with movement of the pivotable bracket shown in dotted (imaginary) line fashion.
Figure 2:
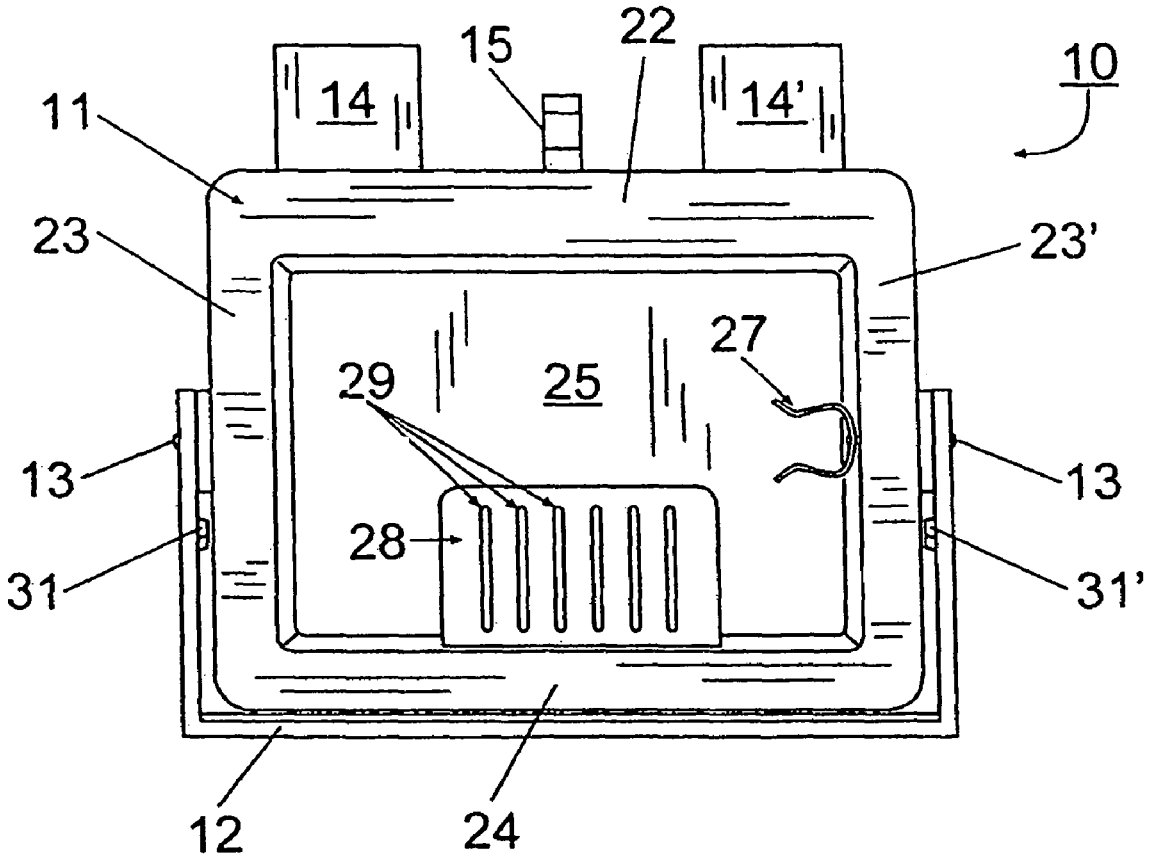
FIG. 2 demonstrates a top plan view of the container device as shown in FIG. 1 but removed from the ladder and without the lid.
Figure 3:
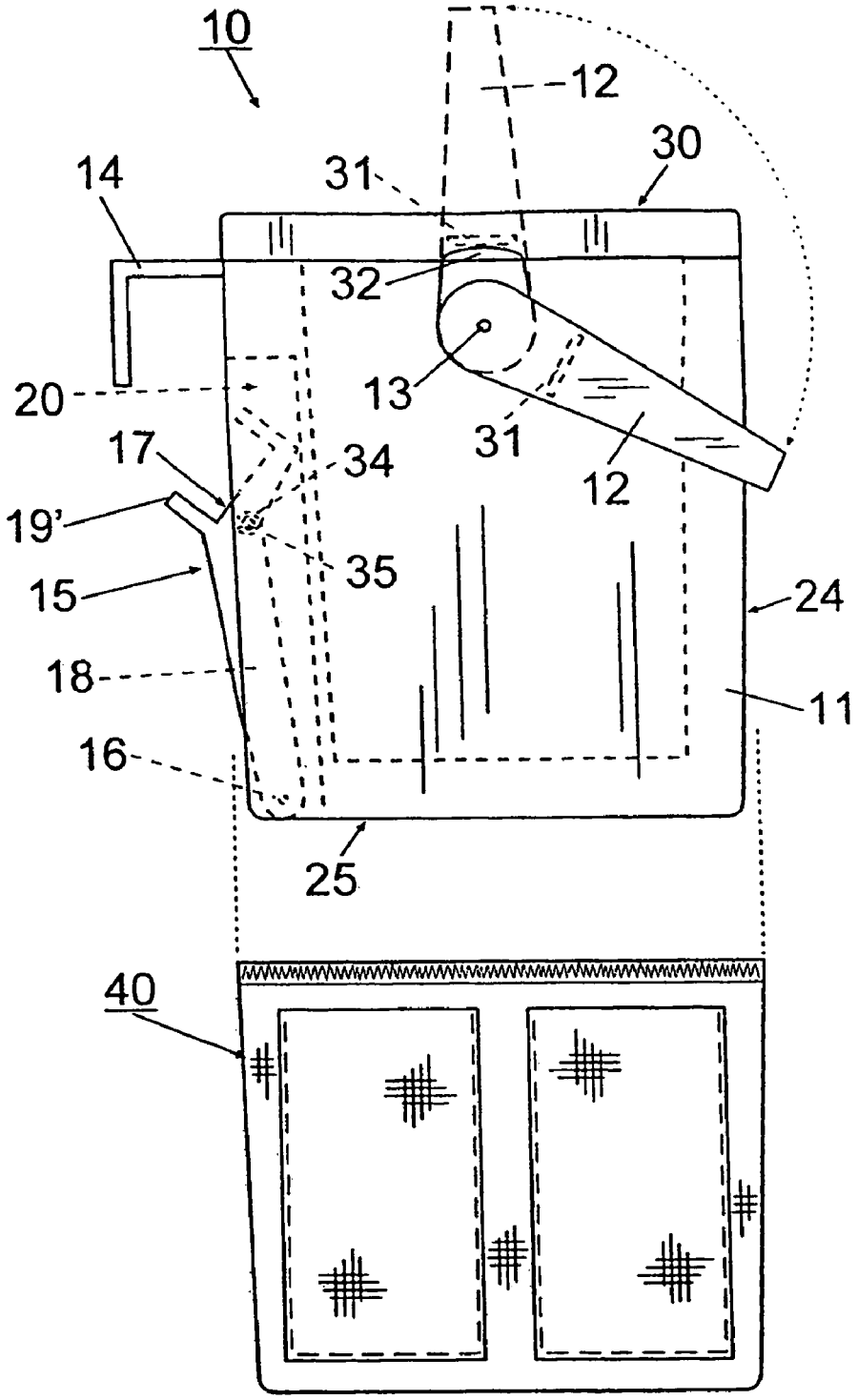
FIG. 3 illustrates a left side elevational view of the container device with the lid in place and the handle lowered, and with movement of the handle shown in dotted line fashion with the cover removed, the right side elevational view being a mirror image thereof.
Figure 4:
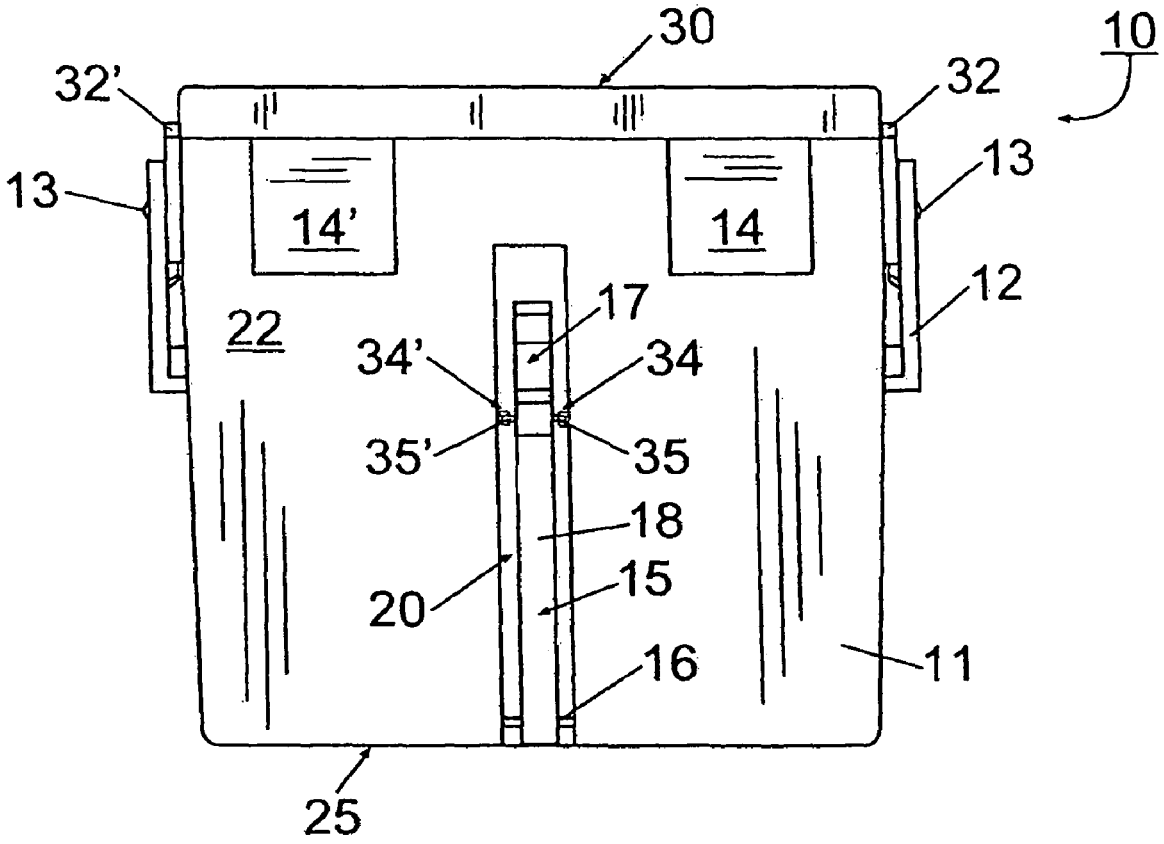
FIG. 4 pictures a rear elevational view of the container device as seen in FIG. 3.
Figure 5:
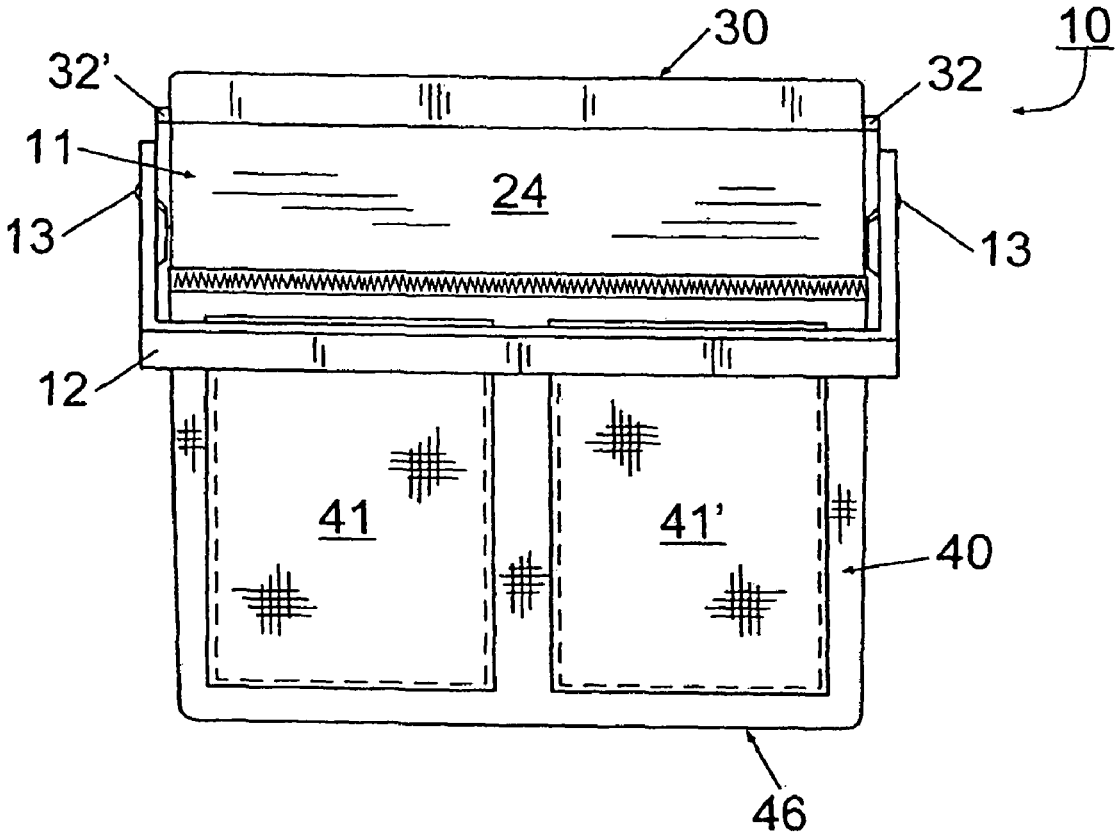
FIG. 5 features a front elevational view of the container device with the lid in place, the cover positioned thereon and the handle lowered.
Figure 6:
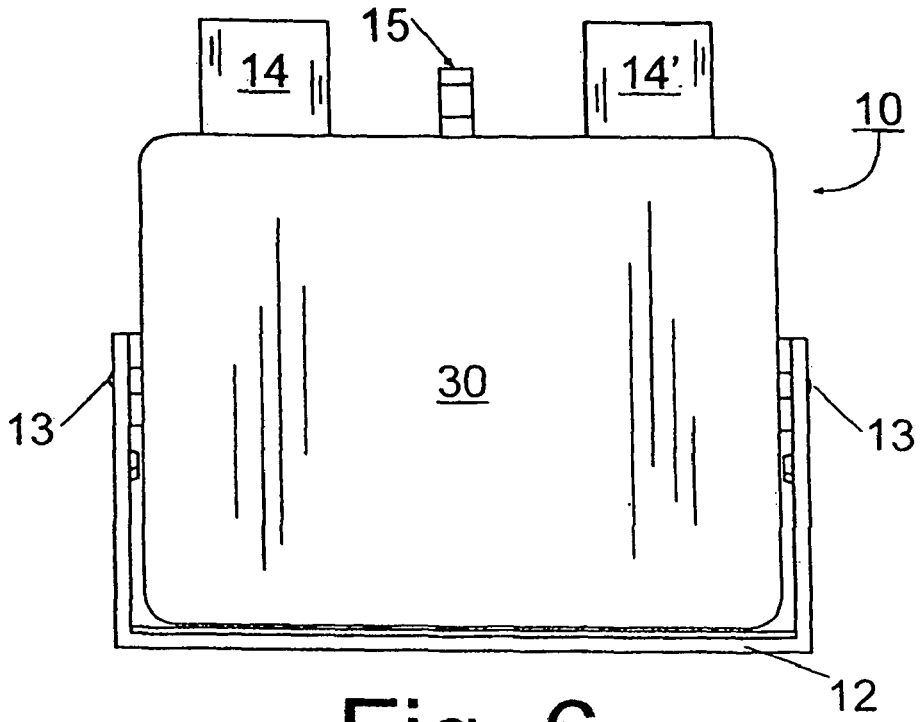
FIG. 6 shows a top plan view of the container device with the lid in place and the handle lowered.
Figure 7:
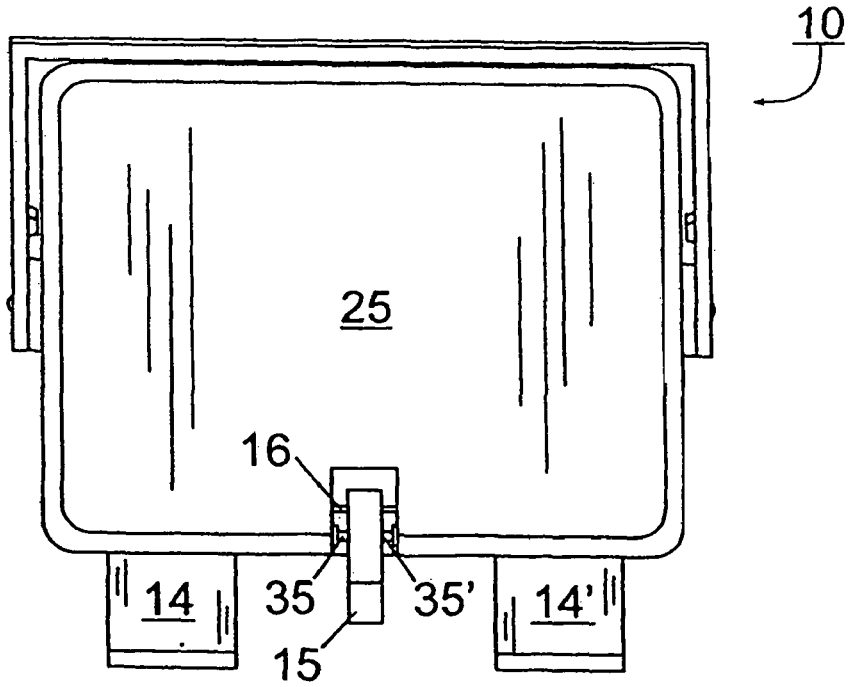
FIG. 7 depicts a bottom view thereof.
Figure 8:
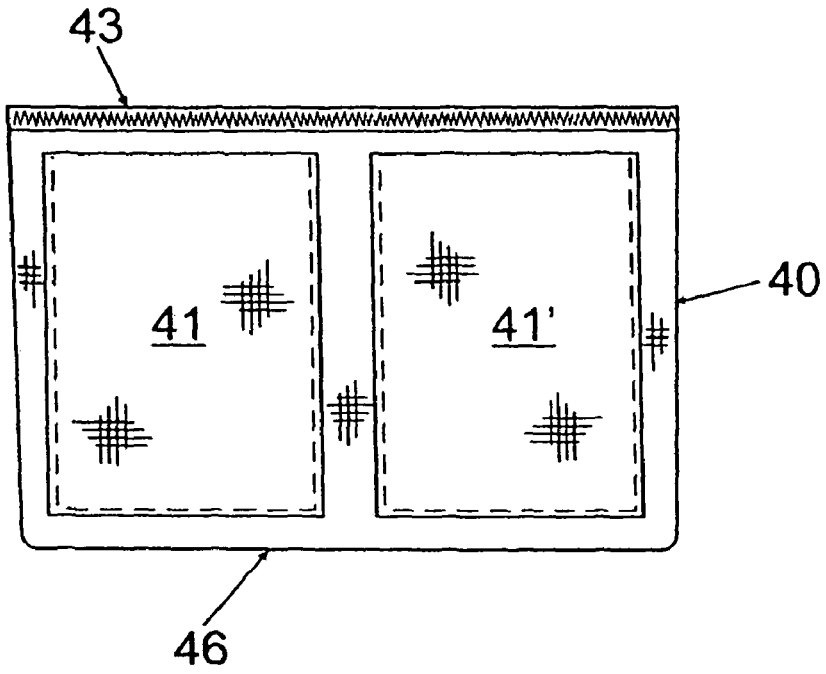
FIG. 8 shows a front elevational view of the cover as removed from the container device.

For a better understanding of the invention and its operation, turning now to the drawings, container device 10 is shown in FIGS. 1-7 and is formed from a conventional plastic or other suitable materials. Device 10 includes substantially rectangular-shaped receptacle 11 with pivotable handle 12 affixed thereto as shown for example in FIGS. 1, 2 and 3. In FIG. 2, handle 12 is seen substantially U-shaped and is joined to receptacle 11 by a pair of pivot axles 13, one on each side. L-shaped brackets 14, 14' seen in FIGS. 2, 3 and 4 are rigidly joined to the rear of receptacle 11 for releasably affixing container device 10 to a ladder rung such as ladder rung 51 of ladder 50 shown in fragmented, imaginary line fashion in FIG. 1. Brackets 14, 14' are immovably attached or integrally molded to receptacle 11 whereas pivotable bracket 15 is affixed to receptacle 11 by cylindrical spindle 16 as seen in FIGS. 1 and 4. Pivotable bracket 15 includes shank 18 and h-shaped head 17 for engaging ladder rung 52 as shown in FIG. 1. Pivotable bracket 15 helps to stabilize container device 10 between ladder rungs 51 and 52 when container device 10 is being used while painting.

As seen in FIGS. 3 and 4, pivotable bracket 15 is shown in a folded, closed posture contained within groove 20. Groove 20 is formed in the outer surface of rear wall 22 of container device 10 during molding. Stud channels 34, 34' (FIG. 4) are formed within groove 20 to tightly receive studs 35, 35' respectively, which are rigidly joined to head 17 to securely maintain pivotable bracket 15 in groove 20 as also seen in FIG. 1. Pivotable bracket head 17 includes fingers 19, 19' (FIG. 1) which engage ladder rung 52 as seen in FIG. 1 to assist in maintaining container device 10 in a level, stable posture when in use on a ladder such as ladder 50.

Wipe board 28 is shown in FIG. 2 attached to the inside of front wall 24 within receptacle 11 and includes a series of slots 29 to allow, for example, a painter after dipping a paint brush (not shown) in paint (not shown) contained within receptacle 11 to wipe the paint brush across wipe board 28 and allow any excess paint therefrom to drain back into receptacle 11. As further seen in FIG. 2, receptacle 11 includes rear wall 22, side walls 23, 23', front wall 24 and bottom 25, and has a capacity for holding approximately one and a half gallons of paint therein. Other sizes and capacities could likewise be manufactured. Brush clamp 27, also seen in FIG. 2, is made from a suitable spring steel wire and is affixed within receptacle 11 to side wall 23', with a means for attachment such as a bolt or screw (not seen), for supporting the handle of a standard paint brush. A painter can thus conveniently pour paint into receptacle 11 and can remove the paint brush (not shown) from clamp 27 when beginning to paint. While painting, should the painter need to lay the paint brush down for a moment, the paint brush can be inserted and maintained in clamp 27.

In order to prevent any paint remaining in receptacle 11 from drying during periods of non-use, lid 30 as shown in FIGS. 1, 3, 4, 5 and 6 is provided. Once lid 30 is placed atop receptacle 11, handle 12 is then rotated as illustrated in imaginary line form in FIG. 3 to an upright position. During rotation, locking tabs 31, 31' (FIGS. 2 and 3) on handle 12 frictionally engage respectively, curved tab slides 32, 32' (FIGS. 3, 4 and 5) on lid 30 to secure and maintain lid 30 in an air tight manner atop container device 10. The locking action of respectively tabs 31, 31' with slides 32, 32' seals lid 30 to container device 10 to prevent drying or spillage of any paint contained within receptacle 11 during transport or storage.

Figure 9:
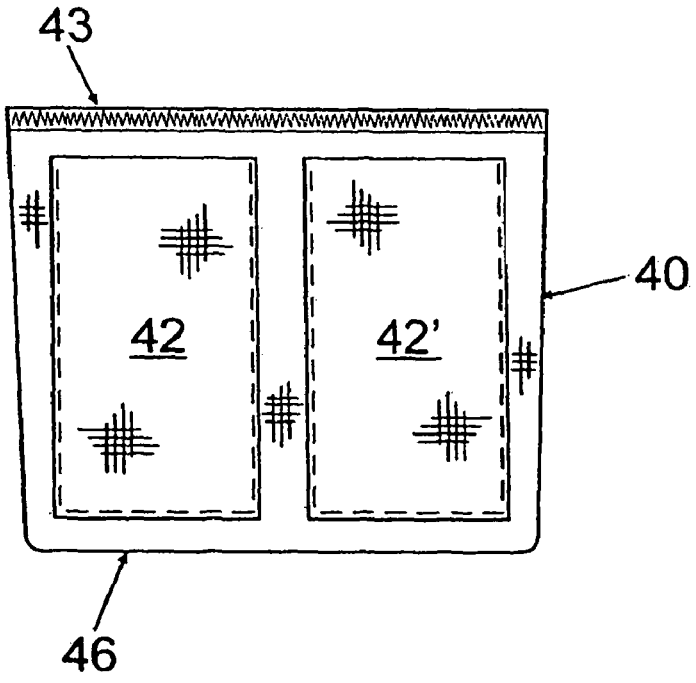
FIG. 9 depicts a left side elevational view of the cover as shown in FIG. 8, the right side elevational view being a mirror image thereof.
Figure 10:
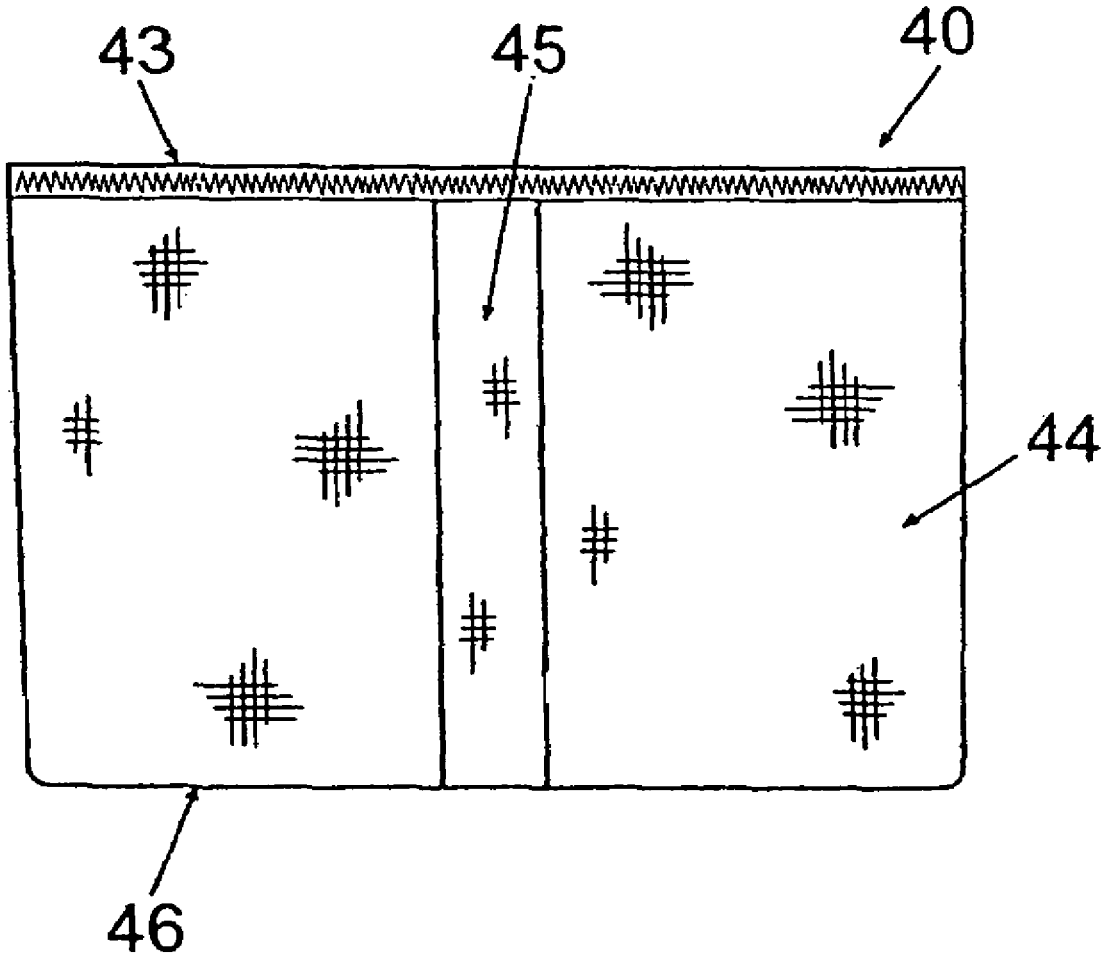
FIG. 10 shows a rear elevational view of the cover as shown in FIG. 8.

For convenience purposes, flexible cover 40 as seen in FIGS. 5, 8, 9 and 10 includes front pockets 41, 41' (FIGS. 5 and 8) and two (2) pairs of side pockets 42, 42' (only one pair of side pockets 42, 42' is shown in FIG. 9), one pair on each side of cover 40. Cover 40 is made from durable, flexible material such as a thin canvas and includes elastic band 43 to frictionally engage the outside of walls 22, 23, 23' and 24 of container device 10 to maintain cover 40 securely thereon. Pockets 41, 41', 42, 42', 42 and 42' allow placement of various painting accessories (not shown) such as putty knives, screwdrivers, rags or other tools in a location for easy access. Rear 44 of cover 40 includes opening 45 as seen in FIG. 10 for access and movement of pivotable bracket 15. Bottom 46 of cover 40 is sized to adequately fit bottom 25 of receptacle 11.

Figure 11:
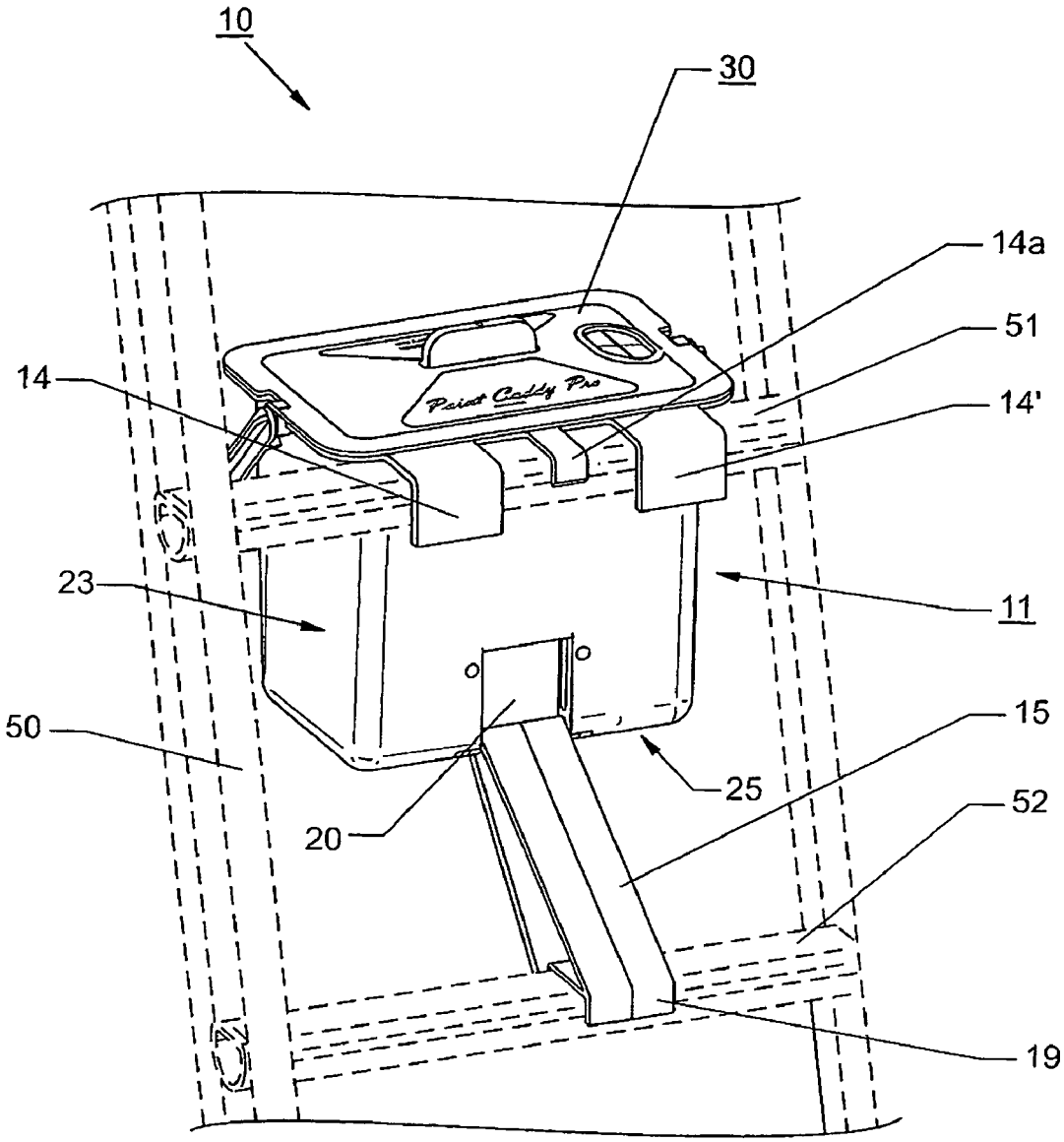
FIG. 11 shows a three-dimensional view of another embodiment of a container device attached to a ladder.

Referring now to FIGS. 11-18, additional exemplary embodiments of the present invention are considered in greater detail. Receptacle 11 has a bottom 25, a front wall 24, a rear wall 22, and a pair of side walls 23 and 23' that define a top opening 11*t*. Other shapes for receptacle 11 may also be used. In FIG. 11, device 10 is shown in use with receptacle 11 in perspective, such that rear wall 22 and one side wall 23 may be seen; bottom 25 is designated (the edge of which is visible)

while top opening 11*t* (not visible) is covered by lid 30 and front wall 24 (not visible) and side wall 23' (not visible) are located behind pictured rear wall 22 and side wall 23. Receptacle 11 has at least one fixed bracket fixedly joined to the rear wall 22 of receptacle 11. In this embodiment, three fixed brackets are shown, 14, 14', and 14*a*, which are fixedly attached or integrally molded to receptacle 11 and define downwardly facing first notches 14N, 14'N, and 14*a*N (see FIG. 12) adapted to receive first ladder rung 51 of ladder 50, so as to releasably affix container device 10 to ladder 50 (see FIG. 11). One or more brackets having shapes other than L-shapes may be used in place of fixed brackets 14, 14', and/or 14*a*, so long as the one or more brackets define one or more downwardly facing notches.

Pivotable bracket 15 is shown attached to ladder rung 52 through the engagement of notch 15N (not visible) formed between fingers 19 and 19' (not visible). Pivotable bracket 15 is longitudinally pivotable, that is, pivotable in a plane substantially parallel to side walls 23 and 23' and substantially perpendicular to ladder rungs 51 and 52. Other shapes (not shown) besides the one illustrated in FIG. 11 may be used for pivotable bracket 15. Also, receptacle 11 may be in the form of another shape (not shown) other than substantially rectangular, with the fixed and pivotable brackets attached to the alternatively shaped receptacle in a manner permitting the brackets to engage ladder rungs 51 and 52, respectively.

Figure 12:
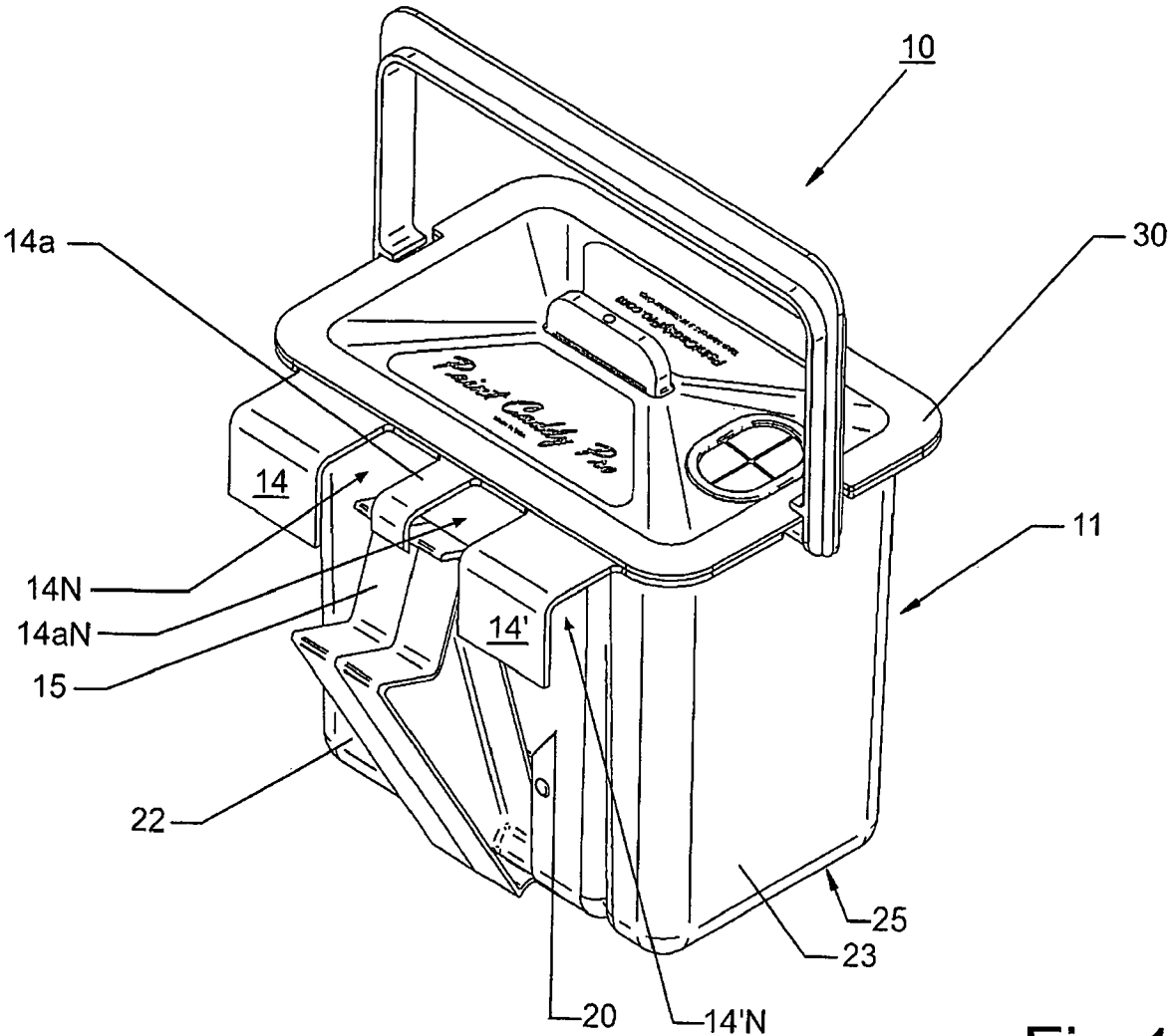
FIG. 12 pictures an embodiment showing a pivotable bracket releasably connected to a fixed bracket.

Notches 14N, 14'N, and 14*a*N are located below top opening 11*t* of receptacle 11 for stability and clearance of lid 30. In addition, this configuration enables fixed L-shaped bracket 14*a* to also function to hold pivotable bracket 15 releasably in place when pivotable bracket 15 is maintained in optional groove 20 (which may be formed in the same longitudinal plane in which pivotable bracket 15 rotates), as shown in FIG. 12, thereby providing increased stability and convenience while container device 10 is carried.

Figure 13:
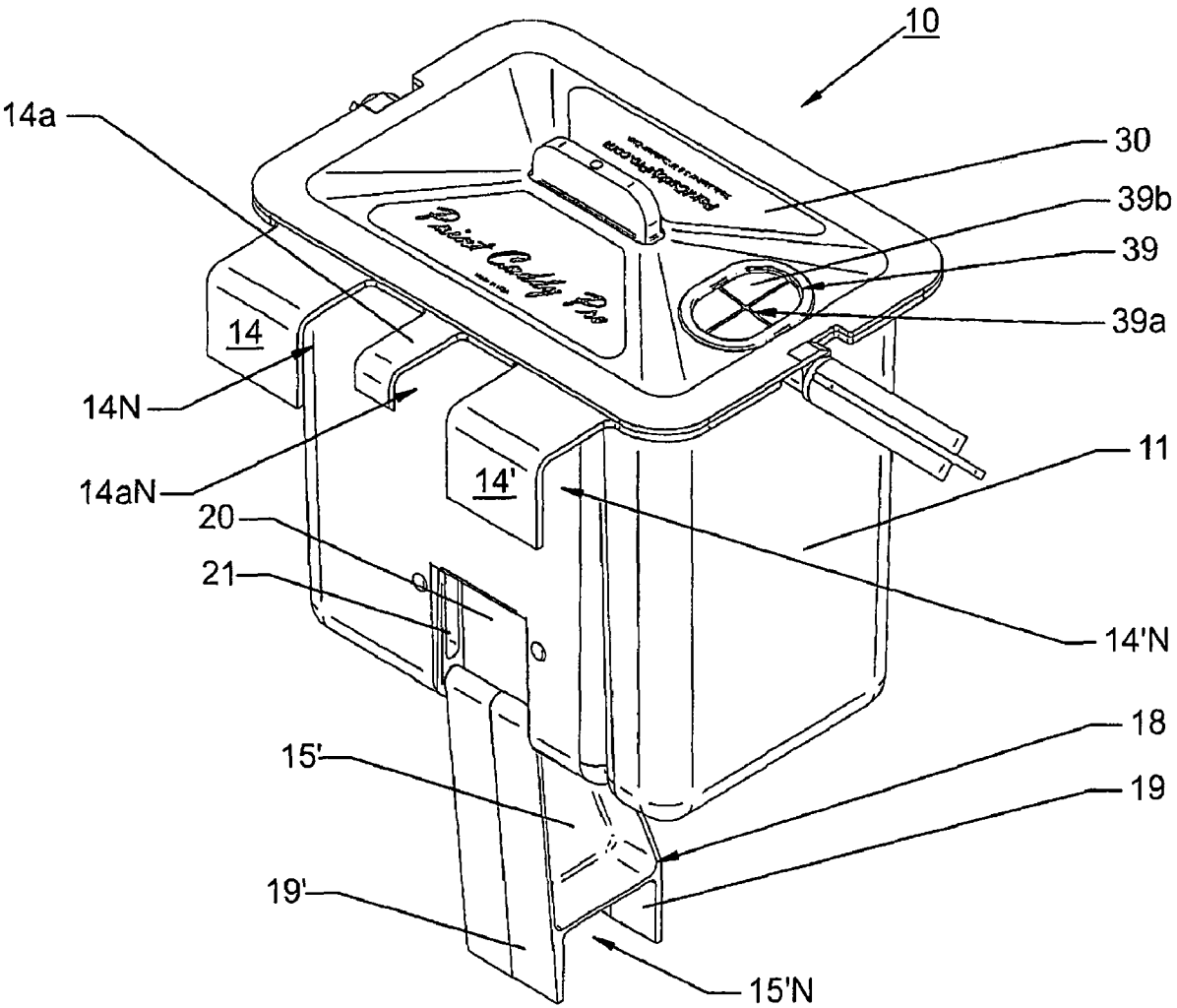
FIG. 13 shows a three-dimensional view of another embodiment of a container device.
Figure 13A:
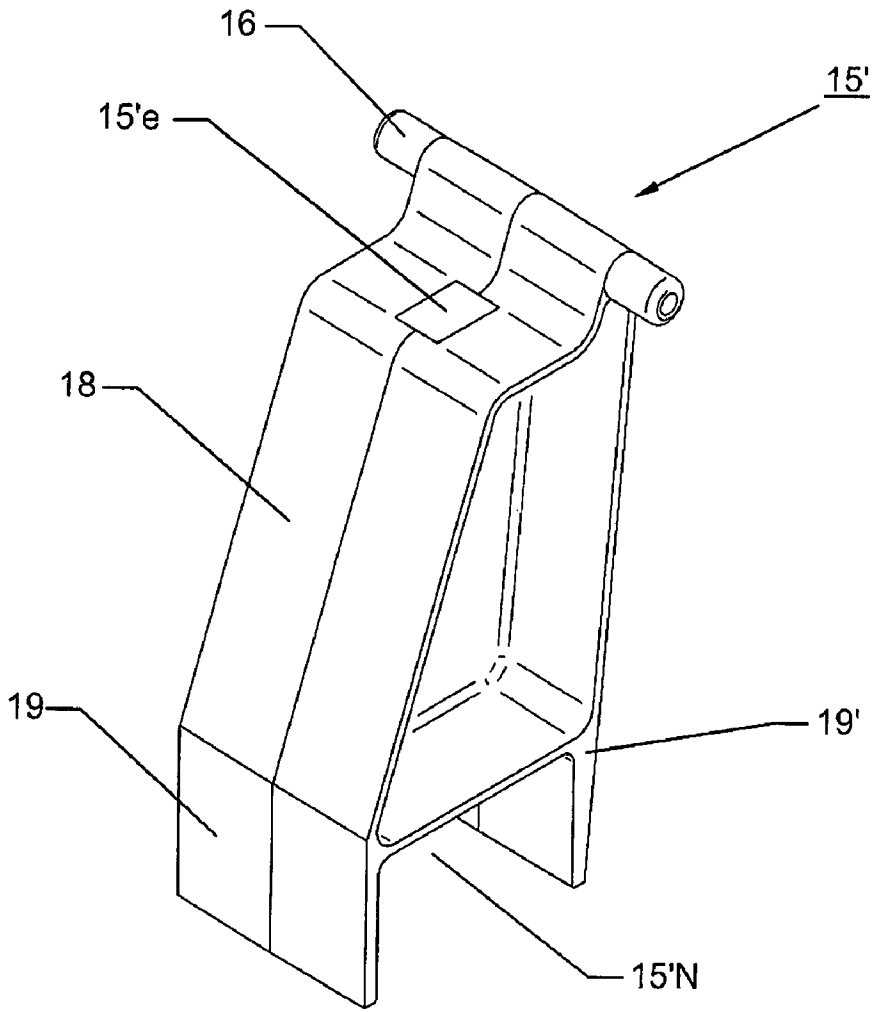
FIG. 13*a* shows a three-dimensional view of a pivotable bracket.
Figure 14:
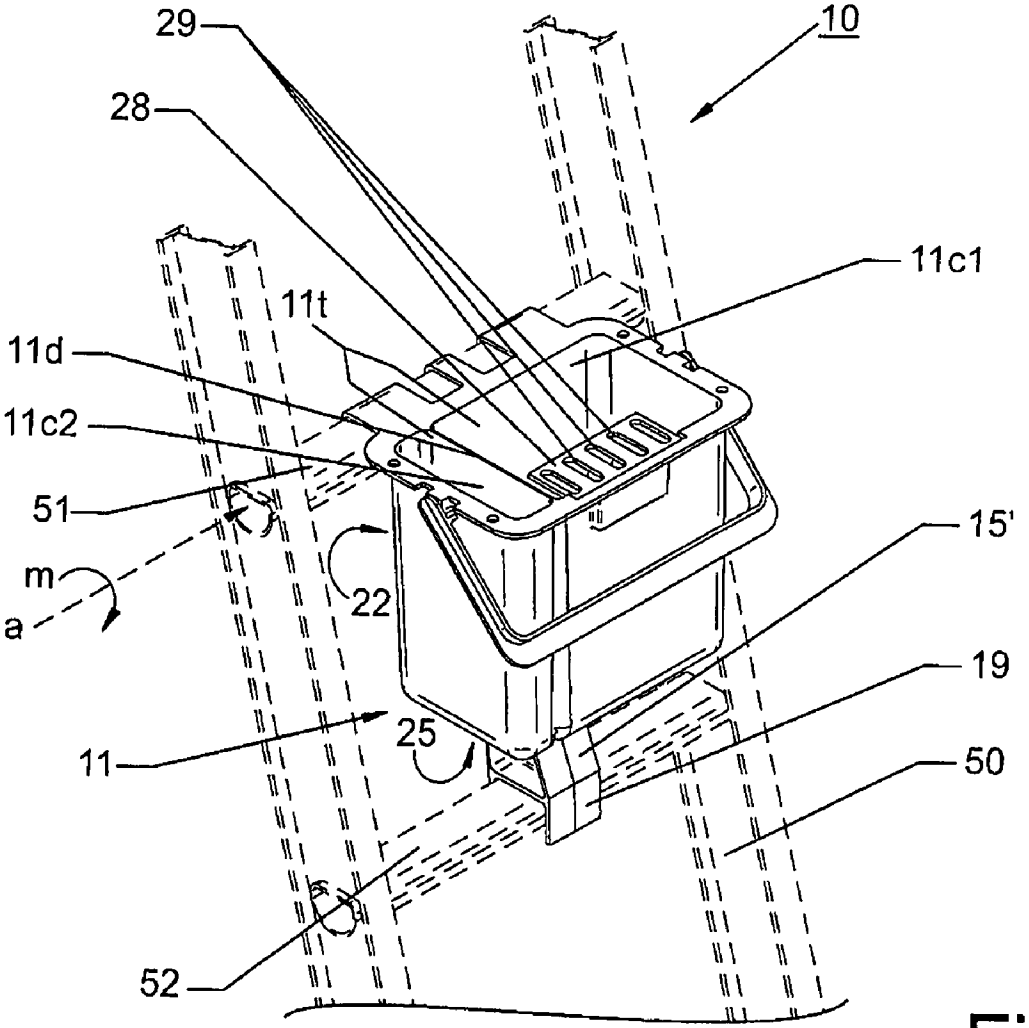
FIG. 14 depicts a three-dimensional view of another embodiment of a container device.

In another exemplary embodiment, shown in FIG. 13, the pivotable bracket, designated in this embodiment as 15', is pivotably attached in a manner capable of a sufficient range of rotation to position fingers 19 and 19' and the notch 15'N formed therebetween directly beneath receptacle 11. FIG. 13 also shows an embodiment in which pivotable bracket 15' is attached to receptacle 11 using one or more arm pivots 21. The pivotable bracket 15' includes an engagement edge 15'*e*, shown in FIG. 13*a*. In FIG. 14, engagement edge 15'*e* (not visible) engages bottom 25 when pivotable bracket 15' has been rotated sufficiently longitudinally away from rear wall 22. The engagement of engagement edge 15'*e* with bottom 25 prevents further rotation of pivotable bracket 15' and provides a counterforce to the force associated with clockwise moment m generated about axis a associated with ladder rung 51 by the weight of receptacle 11 (and any paint therein) and other portions of container device 10. Such an arrangement permits container device 10 to be mounted stably in the front of ladder 50, as shown FIG. 14.

Figure 15:
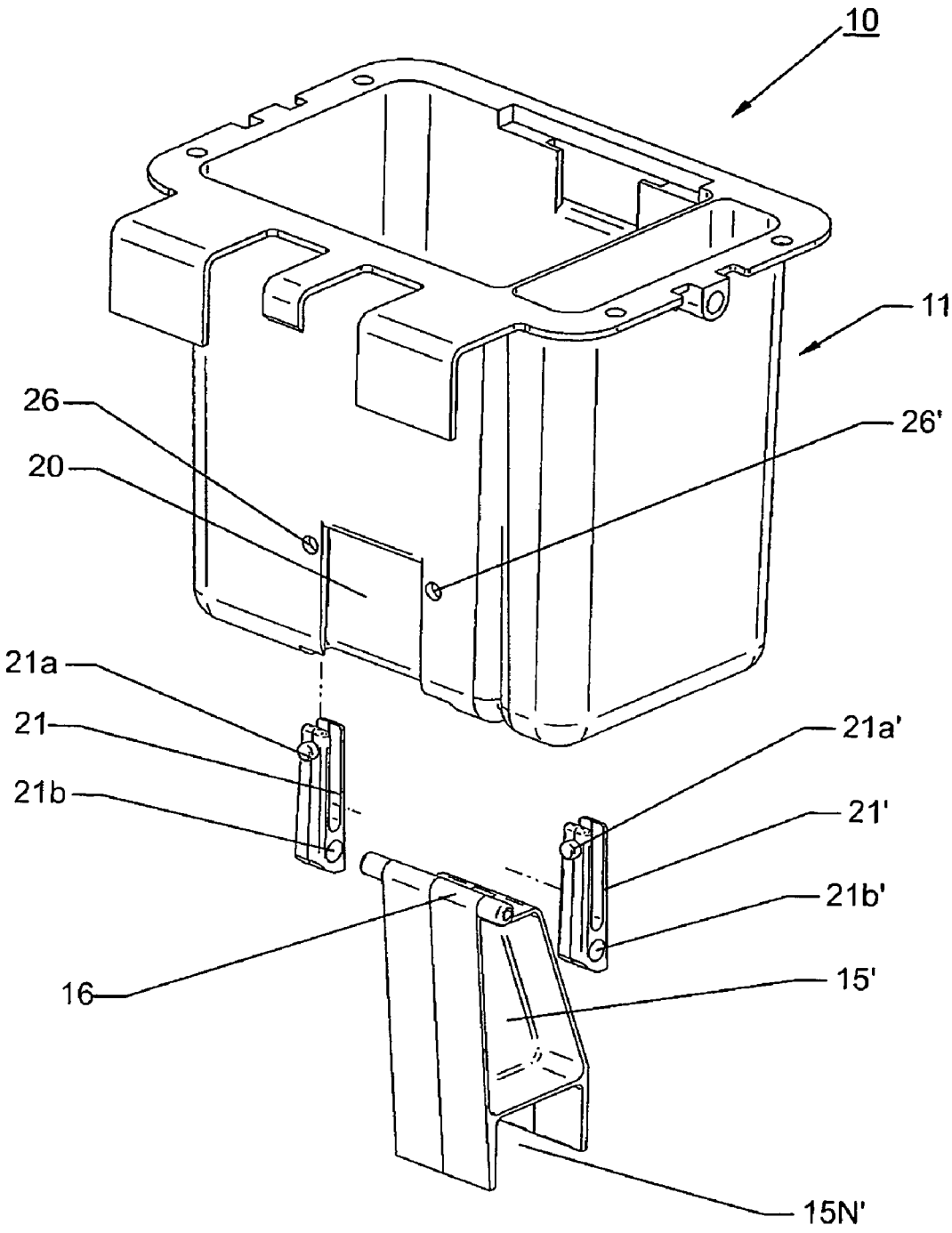
FIG. 15 provides an exploded view of another embodiment of a container device.

FIG. 15 shows an exploded view of an optional aspect of the container device 10 having a pair of arm pivots 21 and 21', each of which includes a locking peg, 21*a* and 21*a*', respectively, and receiving hole, 21*b* and 21*b*', respectively. In this embodiment, pivotable bracket 15' includes a transverse spindle 16 at its proximate end. One end of spindle 16 of pivotable bracket 15' is inserted into receiving hole 21*b* and the other end is inserted into receiving hole 21*b*'. Arm pivots 21 and 21' can then be attached to receptacle 11 by inserting arm pivots 21 and 21' into groove 20 such that locking pegs 21*a* and 21*a*' fit within, respectively, arm-pivot apertures 26 and 26' defined by receptacle 11.

Figure 15A:
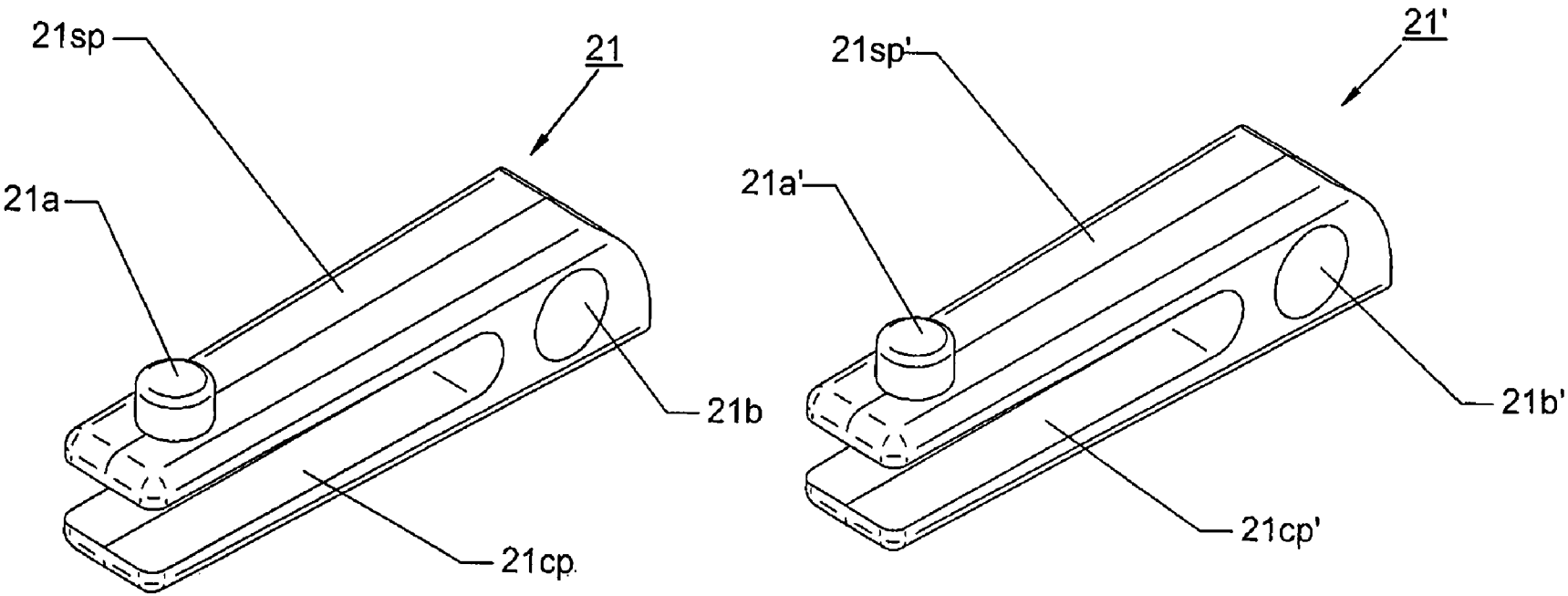
FIG. 15*a* shows a three-dimensional view of two arm pivots.

In one embodiment, this process is facilitated by use of arm pivots 21 and 21' having securing prongs 21*sp* and 21*sp*', respectively, and contacting prongs 21*cp* and 21*cp*', respectively, as shown in FIG. 15*a*. In this embodiment, while arm pivots 21 and 21' are being inserted into groove 20, securing prongs 21*sp* and 21*sp*' are moved closer to contacting prongs 21*cp* and 21*cp*', respectively, to provide clearance for the arm pivots to move. Once locking pegs 21*a* and 21*a*' reach arm-pivot apertures 26 and 26', respectively, the securing prongs 21*sp* and 21*sp*' and contacting prongs 21*cp* and 21*cp*' return to their original position as shown in FIG. 15*a*, thereby inserting locking pegs 21*a* and 21*a*' into arm-pivot apertures 26 and 26', respectively, and securing the arm pivots 21 and 21' and pivotable bracket 15' to receptacle 11.

Arm pivots 21 and 21' may be configured to be releasably attachable to receptacle 11 and pivotable bracket 15', so that pivotable brackets of various lengths may be attached to receptacle 11. The arm pivots 21 and 21' may be released from receptacle 11 by pressing appropriately shaped objects (not shown) against locking pegs 21*a* and 21*a*' to remove them from arm-pivot apertures 26 and 26', respectively. After that removal, the arm pivots 21 and 21' and pivotable bracket 15' may be more easily moved down groove 20 and away from receptacle 11. Thus, pivotable bracket 15' shown in FIG. 15 and pivotable bracket 15 shown in FIG. 11 may be substituted for one another or for other types of pivotable brackets in order to facilitate both front-ladder mounting and rear-ladder mounting using pivotable bracket notch 15N or 15N'.

In another embodiment (not shown), a pivotable bracket capable of being extended to various lengths is used. Such an extendable pivotable bracket may be formed using a telescoping arm having a plurality of sections and a ball-bearing-based extension mechanism or using another type of suitable extendable member. This embodiment provides additional options for positioning pivotable bracket notch 15N or 15N'.

Returning to FIG. 14, receptacle 11 may be divided into two compartments as shown: first compartment 11*c*1 and second compartment 11*c*2. (Top opening 11*t* is likewise divided into two sections corresponding to 11*c*1 and 11*c*2.) First and second compartments 11*c*1 and 11*c*2 are separated from each other by dividing wall 11*d*. In one embodiment, first compartment 11*c*1 is substantially larger than second compartment 11*c*2, with the former intended as a holding area for paint (not shown) and the latter intended as a holding area for a paint brush and/or other painting supplies (not shown). Wipe board 28 with series of slots 29 may be positioned at or near the top of first compartment 11*c*1 as shown in FIG. 14. Though not shown in FIG. 14, a clamp (such as clamp 27 shown in FIG. 2) suitable for holding a paint brush (not shown) may be positioned within second compartment 11*c*2.

Figure 16:
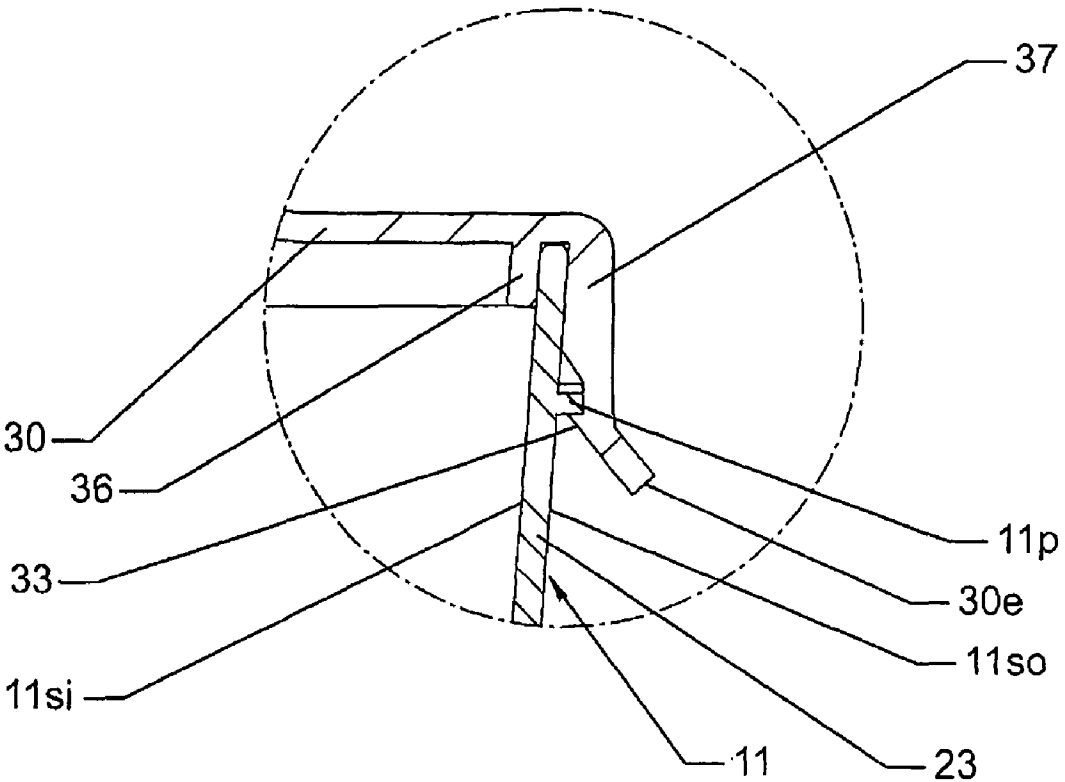
FIG. 16 shows a detailed view of a portion of a receptacle side wall and a portion of a lid.

FIG. 16 shows a detailed view of a portion of an embodiment of side wall 23 and of lid 30 to help illustrate how lid 30 may be secured to receptacle 11. Securing lid 30 to receptacle 11 with a substantially air tight seal enables a painter to pause with a lower risk of drying the paint or the bristles of any brush. In this embodiment, a protuberance 11*p* is continuously disposed around the perimeter of receptacle 11 at or near the top of the outer surface of receptacle 11. A locking hook 33 is continuously disposed around lid 30 at or near its outside edge 30*e*, so as to fall outside the walls (i.e., front wall 24, rear wall 22, and side walls 23 and 23') of receptacle 11. Lid 30 also includes an inner sealing ring 36 continuously disposed close enough to outside edge 30*e* of lid 30 to be at a position that places it within the walls (i.e., front wall 24, rear wall 22, and side walls 23 and 23') of receptacle 11 when lid 30 is secured to receptacle 11. An outer sealing ring 37 is continuously disposed around lid 30 at a position between locking hook 33 and inner sealing ring 36.

Lid 30 can be secured to receptacle 11 by positioning locking hook 33 against protuberance 11*p*. Placing locking hook 33 in such a position also places inner sealing ring 36 against the inside surface 11*si* of side wall 23 and outer sealing ring 37 against the outside surface 11*so* of receptacle side wall 23. Inner sealing ring 36 and outer sealing ring 37 may also be pressed against the inside surfaces and outside surfaces, respectively, of the other side wall 23' (not shown), front wall 24 (not shown), and rear wall 22 (not shown). In this configuration, inner sealing ring 36 and outer sealing ring 37 apply sufficient pressure to seal receptacle 11 in an airtight or substantially airtight manner. Locking hook 33 is releasably positioned against protuberance 11*p*, so that lid 30 can be removed in order to reestablish access to the interior of receptacle 11.

Figure 17:
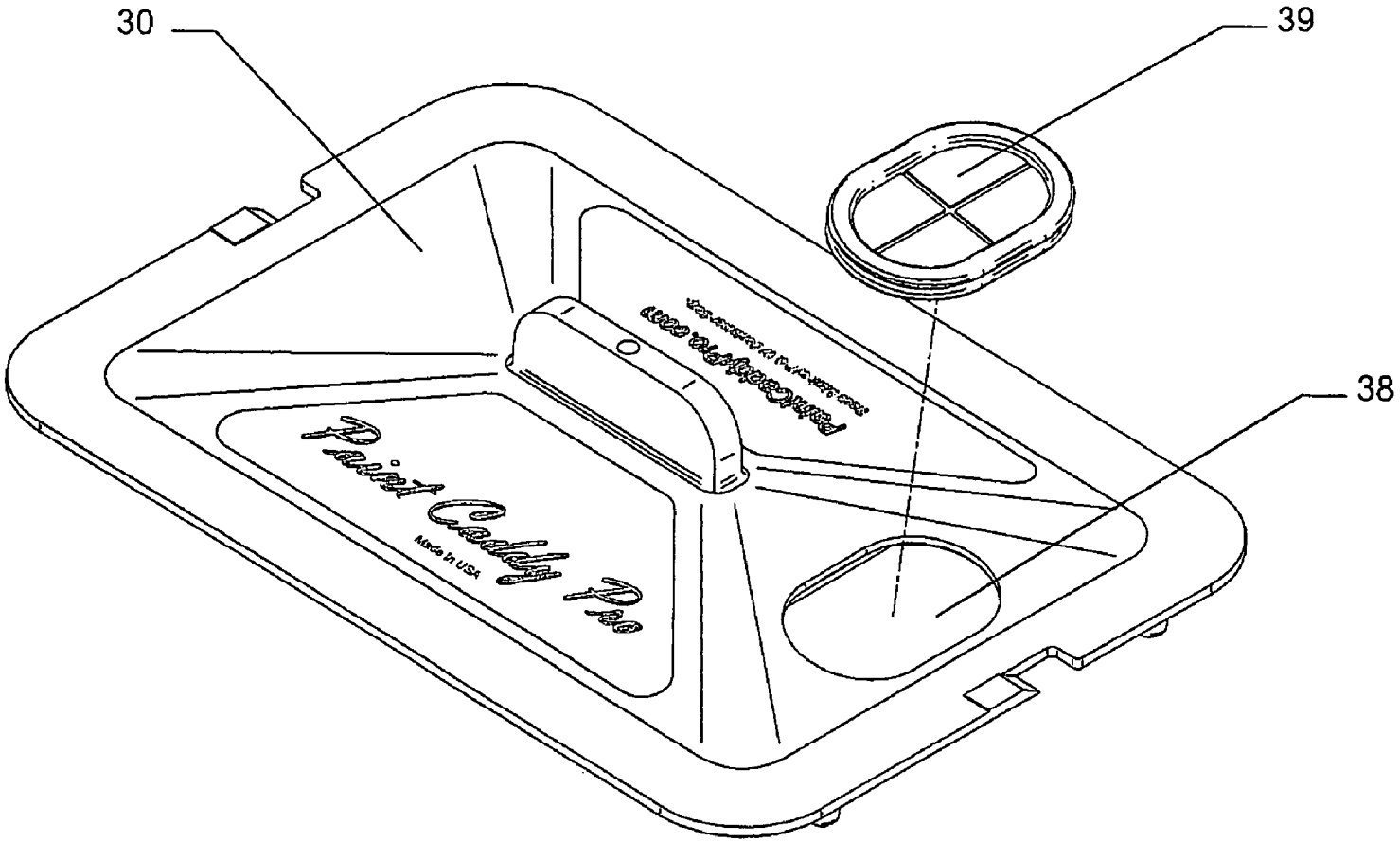
FIG. 17 provides an exploded view of an embodiment of a lid (with hole) and a grommet.
Figure 18:
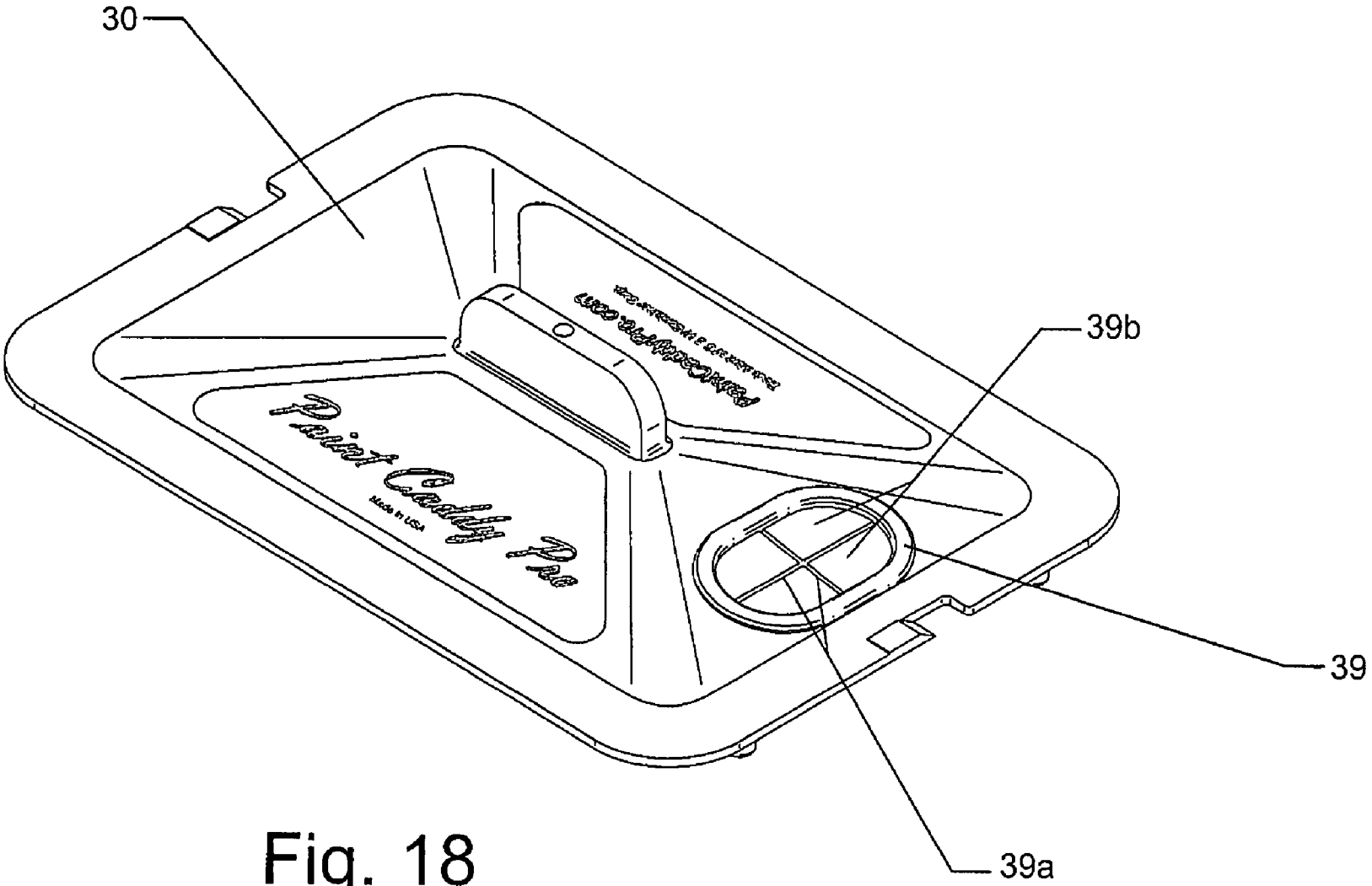
FIG. 18 shows a three-dimensional view of a lid with a grommet.

In exploded view FIG. 17, lid 30 defines a hole 38. Hole 38 is designed to receive a flexible grommet 39, which can be made of rubber, plastic, or other suitable material. FIG. 18 shows grommet 39 disposed within hole 38 (no longer visible) and further shows slits 39*a* used to form a plurality of flexible portions 39*b*. Flexible portions 39*b* are capable of frictionally engaging an object, such as a paint brush handle (not shown), thereby permitting a painter to secure lid 30 onto receptacle 11 (as shown, e.g., in FIG. 13) without first removing any paint brush that may be present in receptacle 11. In this manner, a brush is more likely to remain wet and not dry from exposure to air; further, the brush may be oriented in a desired vertical manner that avoids contact between the bristles of the brush and solid surfaces, thereby preventing damage to the bristles.

Figure 19:
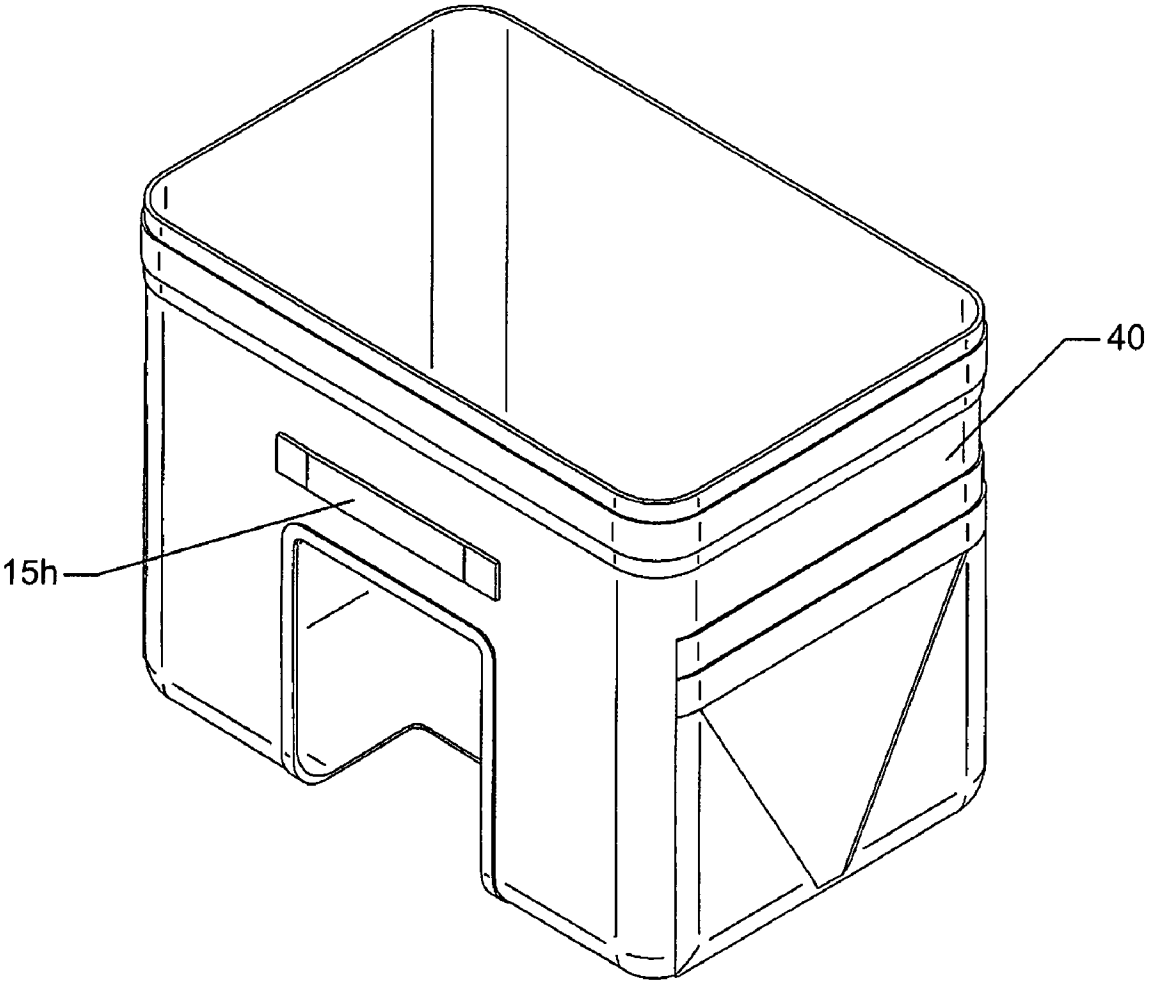
FIG. 19 shows a cover with a holding strap.
Figure 20:
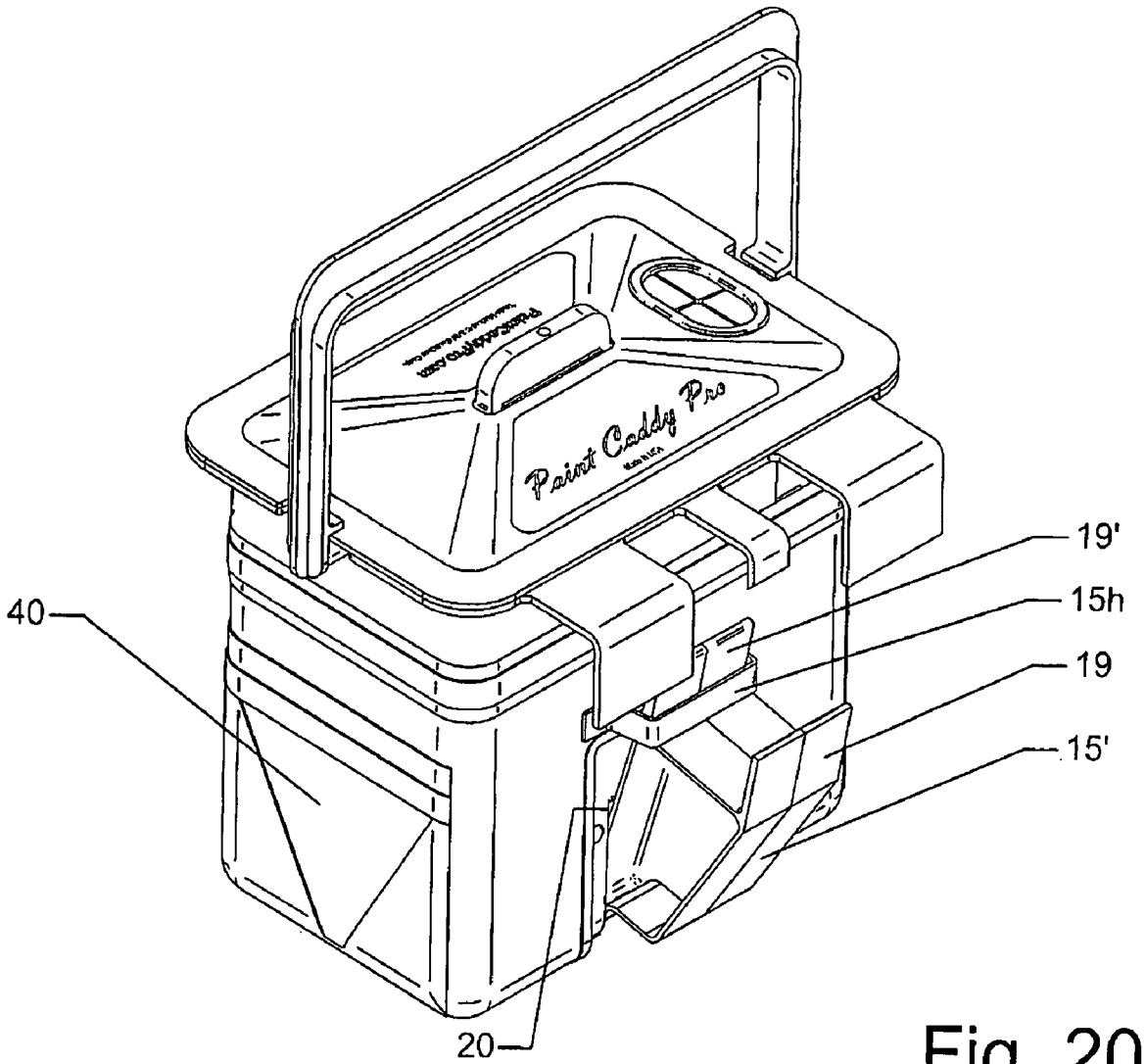
FIG. 20 shows a container device with a pivotable bracket held by a holding strap.

FIG. 19 shows an embodiment of flexible cover 40 having a holding strap 15*h*. The holding strap 15*h* may be an elastic material to which pivotable bracket 15' may be releasably connected when maintained in groove 20 as shown in FIG. 20. In an alternative embodiment (not shown), holding strap 15*h* may be attached to receptacle 11.

The illustrations and examples provided herein are for explanatory purposes and are not intended to limit the scope of the appended claims.

What is claimed is:

1. A container device for releasable attachment to a ladder having a plurality of rungs, the container device comprising:

a receptacle, said receptacle comprising a bottom, a front wall, a rear wall, and a pair of side walls, wherein the front wall, rear wall, and pair of side walls define a top opening;

at least one fixed bracket, said at least one fixed bracket fixedly attached to said receptacle and extending out from the receptacle to define a downwardly facing first notch adapted to receive a first ladder rung;

a longitudinally pivotable bracket having a proximal end and a distal end, said pivotable bracket pivotably attached to said receptacle at the pivotable bracket's proximal end and adapted to receive a second ladder rung at its distal end;

wherein said first notch is located below the top opening of said receptacle;

a pivotable handle attached to said receptacle comprising locking tabs on said pivotable handle;

a lid comprising tab slides on said lid, wherein said locking tabs frictionally engage said tab slides when said pivotable handle is rotated to a substantially vertical position.

2. The container device of claim 1, wherein the at least one fixed bracket comprises a first fixed bracket and a second fixed bracket, said second fixed bracket fixedly attached to said receptacle and extending out from the receptacle to define a second downwardly facing notch adapted to receive the first ladder rung, wherein said second notch is located below the top opening of said receptacle.

3. The container device of claim 1 wherein said pivotable bracket comprises a shank pivotably attached at or near the bottom of the rear wall of said receptacle at the pivotable bracket's proximal end, the shank extending to the distal end of the bracket, and the pivotable bracket further comprises fingers at the distal end of the bracket, said fingers being attached to said shank and adapted to receive a second ladder rung.

4. The container device of claim 3 wherein the at least one fixed bracket comprises a first fixed bracket and a second fixed bracket, wherein said first fixed bracket and said second fixed bracket are fixedly attached to the rear wall of the receptacle.

5. The container device of claim 4 wherein the first fixed bracket and the second fixed bracket are L-shaped.

6. The container device of claim 3 wherein said pivotable bracket is capable of a range of rotation sufficient to position said fingers at a location below said receptacle.

7. The container device of claim 3 wherein: said pivotable bracket further comprises an engagement edge; and said pivotable bracket is capable of a range of rotation sufficient to position the engagement edge against the bottom of the receptacle and to position said fingers at a location directly beneath said receptacle.

8. The container device of claim 1 wherein said pivotable bracket comprises a shank pivotably attached at or near the bottom of said receptacle at the pivotable bracket's proximal end, the shank extending to the distal end of the bracket, and the pivotable bracket further comprises fingers at the distal end of the bracket, said fingers being attached to said shank and adapted to receive a second ladder rung.

9. The container device of claim 1, further comprising two arm pivots, wherein said pivotable bracket is releasably connected to said two arm pivots and said two arm pivots are releasably connected to said receptacle.

10. The container device of claim 1 wherein said receptacle defines a groove and said pivotable bracket is able to be maintained within said groove.

11. The container device of claim 10, wherein the at least one fixed bracket comprises a first fixed bracket, a second fixed bracket, and a third fixed bracket, wherein said second and third fixed brackets are fixedly attached to said receptacle and extend out from the receptacle to define a second downwardly facing notch and a third downwardly facing notch adapted to receive the first ladder rung, wherein said second and third notches are located below the top opening of said receptacle.

12. The container device of claim 11 wherein said pivotable bracket is releasably connectable to said third fixed bracket when said pivotable bracket is maintained in said groove.

13. The container device of claim 11 further comprising a holding strap attached to the rear wall of said receptacle, wherein said pivotable bracket is releasably connectable to said holding strap when said pivotable bracket is maintained in said groove.

14. The container device of claim 1 wherein said receptacle further comprises a dividing wall, wherein said dividing wall divides the receptacle into a first compartment and a second compartment.

15. The container device of claim 14 wherein said first compartment is substantially larger than said second compartment.

16. The container device of claim 1 further comprising a cover, said cover positioned on said receptacle.

17. The container device of claim 16, further comprising two arm pivots, wherein (a) the at least one fixed bracket comprises a first fixed bracket, a second fixed bracket, and a third fixed bracket, said second and third fixed brackets fixedly attached to said receptacle and extending out from the receptacle to define a second downwardly facing notch and a third downwardly facing notch, wherein said second and third notches are adapted to receive the first ladder rung and are located below the top opening of said receptacle;

(b) the receptacle further comprises a dividing wall, wherein said dividing wall divides the receptacle into a first compartment and a second compartment;

(c) the first compartment is substantially larger than said second compartment;

(d) the pivotable bracket comprises a shank pivotably attached at or near the bottom of the rear wall of said receptacle at the pivotable bracket's proximal end, the shank extending to the distal end of the bracket, and the pivotable bracket further comprising fingers at the distal end of the bracket, said fingers being attached to said shank and adapted to receive a second ladder rung;

(e) the pivotable bracket is capable of a range of rotation sufficient to position said fingers at a location below said receptacle;

(f) the pivotable bracket is releasably connected to said two arm pivots and said two arm pivots are releasably connected to said receptacle;

(g) said receptacle defines a groove and said pivotable bracket is able to be maintained within said groove; and (h) said cover:

(i) is formed from a flexible material;

(ii) defines a cover opening aligned with said groove; and (iii) includes one or more pockets, said one or more pockets formed from a flexible material.

18. The container device of claim 17, further comprising a holding strap attached to said cover, wherein said pivotable bracket is releasably connectable to said holding strap when said pivotable bracket is maintained in said groove.

19. The container device of claim 17 wherein the flexible material forming said cover and said one or more pockets is canvas.

20. The container device of claim 17 further comprising an elastic band, wherein said elastic band is attached to said cover and formed from a flexible material.

21. A container device for releasably attaching to a ladder having a plurality of rungs, the device comprising:

a receptacle, said receptacle comprising a bottom, a front wall, a rear wall, and a pair of side walls, wherein the front wall, rear wall, and pair of side walls define a top opening;

a lid, said lid positionable on said receptacle to seal said receptacle;

at least one fixed bracket, said at least one fixed bracket fixedly attached to said receptacle and extending out from the receptacle to define a downwardly facing first notch adapted to receive a first ladder rung;

a longitudinally pivotable bracket having a proximal end and a distal end, said pivotable bracket pivotably attached to said receptacle at the pivotable bracket's proximal end and adapted to receive a second ladder rung at its distal end;

wherein first notch is located below the top opening of said receptacle;

said receptacle further comprising a dividing wall, dividing the receptacle into a first compartment and a second compartment; and wherein said lid defines a hole and further comprises a flexible grommet disposed within the hole, said hole and said grommet positioned above said second compartment.

22. The container device of claim 21 wherein (a) said receptacle has an outside surface and an inside surface and further comprises a protuberance continuously disposed around the perimeter of the receptacle at or near the top of the receptacle on the outside surface of the receptacle;

(b) said lid has an outside edge and further comprises;

(i) a locking hook continuously disposed around said lid at or near the outside edge;

(ii) an inner sealing ring continuously disposed around said lid near the outside edge; and (iii) an outer sealing ring continuously disposed around said lid at a position between the locking hook and the inner sealing ring; and (c) said locking hook is releasably positionable against said protuberance, said inner sealing ring is releasably positionable against the inside surface of said receptacle, and said outer sealing ring is releasably positionable against the outside surface of said receptacle with sufficient pressure to seal said receptacle in an airtight or substantially airtight manner.

23. The container device of claim 21 further comprising a pivotable handle attached to said receptacle.

24. The container device of claim 23 further comprising locking tabs on said pivotable handle and tab slides on said lid, wherein said locking tabs frictionally engage said tab slides when said pivotable handle is rotated to a substantially vertical position.

25. The container device of claim 21 further comprising a clamp, said clamp affixed to said receptacle for mounting a brush.

26. The container device of claim 21 further comprising a wipe board, said wipe board attached to said receptacle.

27. The container device of claim 21 further comprising a cover, said cover positioned on said receptacle.

28. The container device of claim 21 wherein said receptacle defines a groove and said pivotable bracket is able to be maintained within said groove.

29. The container device of claim 21 wherein said lid defines a hole and further comprises a flexible grommet disposed within the hole, the grommet having one or more slits, said slits forming a plurality of flexible portions, said flexible portions capable of frictionally engaging an object positioned within said grommet.

30. The container device of claim 21 wherein said first compartment is substantially larger than said second compartment.

31. The container device of claim 30 further comprising a wipe board, said wipe board attached to said first compartment.

32. The container device of claim 30 further comprising a clamp, said clamp attached to said second compartment.

33. The container device of claim 21 wherein said grommet includes one or more slits, said slits forming a plurality of flexible portions, said flexible portions capable of frictionally engaging an object positioned within said grommet.

34. A container device for attachment to a ladder having a plurality of rungs, the container device comprising:

a receptacle, said receptacle comprising a bottom, a front wall, a rear wall, and a pair of side walls, wherein the front wall, rear wall, and pair of side walls define a top opening;

at least one fixed bracket, said at least one fixed bracket fixedly attached to said receptacle and extending out from the receptacle to define a downwardly facing first notch adapted to receive a first ladder rung;

a longitudinally pivotable bracket having a proximal end and a distal end, said pivotable bracket pivotably attached to said receptacle at the pivotable bracket's proximal end and adapted to receive a second ladder rung at its distal end;

a lid, that defines a hole and is positionable on said receptacle to seal said receptacle;

a flexible grommet disposed within the hole; and wherein said first notch is located below the top opening of said receptacle.

* * * * *